United States Patent [19]

Levinson

[11] Patent Number: 4,774,435

[45] Date of Patent: Sep. 27, 1988

[54] THIN FILM ELECTROLUMINESCENT DEVICE

[75] Inventor: Mark Levinson, Sudbury, Mass.

[73] Assignee: GTE Laboratories Incorporated, Waltham, Mass.

[21] Appl. No.: 136,327

[22] Filed: Dec. 22, 1987

[51] Int. Cl.[4] ..... H05B 33/12

[52] U.S. Cl. ..... 313/509

[58] Field of Search ..... 313/509

[56] References Cited

U.S. PATENT DOCUMENTS 4,518,891 5/1985 Howard, Jr. ..... 313/509 X 4,670,690 6/1987 Ketchypel ..... 313/509 X

FOREIGN PATENT DOCUMENTS 0015689 2/1979 Japan ..... 313/509

*Primary Examiner*—Palmer C. DeMeo

*Attorney, Agent, or Firm*—David M. Keay

[57] ABSTRACT

A thin film electroluminescent device including a transparent substrate having a smooth, planar exterior surface and a rough, non-planar interior surface. Layers of a first transparent electrode of indium tin oxide or tin oxide, an insulating material, for example, silicon oxynitride, manganese activated zinc sulfide, an insulating material, and a second electrode of aluminum are deposited in order on the rough, non-planar interior surface of the substrate. The rough, non-planar interface between the phosphor and insulating material provides surfaces at different angles to the light generated within the phosphor layer preventing light from being trapped within the phosphor layer.

5 Claims, 1 Drawing Sheet

THIN FILM ELECTROLUMINESCENT DEVICE

BACKGROUND OF THE INVENTION

This invention relates to electroluminescent devices. More particularly, it is concerned with thin film electroluminescent devices in which an active element of a thin layer of phosphor material is sandwiched between two dielectric films.

Thin film electroluminescent devices are employed for various forms of displays. Typically the devices employ a transparent substrate having on one surface a very thin conductive electrode which is substantially transparent. This first electrode is covered with an insulating layer. A layer of a suitable phosphor material overlies the insulating layer. The phosphor layer is covered with another insulating layer, and a second conductive electrode of an appropriate pattern is formed on the second insulating layer. Under operating conditions a voltage is applied between the two electrodes causing the portion of the phosphor layer between the electrodes to luminesce, thus providing a visible pattern when viewed through the transparent substrate.

Typically the phosphor layer is a host of zinc sulfide containing an activator, frequently manganese. Light generated in this phosphor layer by the voltage across the electrodes passes through the layer of insulating material and the conductive electrode to be viewed as it passes through the transparent substrate. Some of the light generated in the phosphor layer passes through the other insulating layer to the second conductive electrode. When the second electrode is of a reflecting material, such as aluminum, the light striking the second electrode is reflected back through the layers of the device passing through the transparent substrate as visible light. Since in conventional devices the layers are of planar geometry, some of the light generated in the phosphor layer is trapped within the phosphor layer by internal reflection at the interfaces of the phosphor layer and the two layers of insulating material, and consequently does not become visible.

SUMMARY OF THE INVENTION

A thin film electroluminescent device in accordance with the present invention comprises a substrate of transparent material having a substantially flat, planar, external surface and having a rough, non-planar interior surface. A first transparent film of conductive material overlies the substrate and is adherent thereto. The first transparent film of conductive material has a first rough, non-planar surface contiguous with the rough, non-planar interior surface of the substrate, and has a second rough, non-planar surface spaced from its first surface. A first coating of insulating material overlies the first transparent film of conductive material and is adherent thereto. The first coating of insulating material has a first rough, non-planar surface contiguous with the second rough, non-planar surface of the first transparent film of conductive material. The first coating of insulating material has a second rough, non-planar surface which is spaced from its first surface. A layer of phosphor material overlies the first coating of insulating material and is adherent thereto. The layer of phosphor material has a first rough, non-planar surface contiguous with the second rough, non-planar surface of the first coating of insulating material, and has a second rough, non-planar surface spaced from its first surface.

A second layer of insulating material overlies the layer of phosphor material and is adherent thereto. The second layer of insulating material has a rough, non-planar surface contiguous with the second rough, non-planar surface of the layer of phosphor material. A second layer of conductive material overlies the second coating of insulating material and is adherent thereto.

For a better understanding of the present invention, together with other and further objects, advantages, and capabilities thereof, reference is made to the following disclosure and appended claims in connection with the above described drawings.

DETAILED DESCRIPTION

Figure 1:
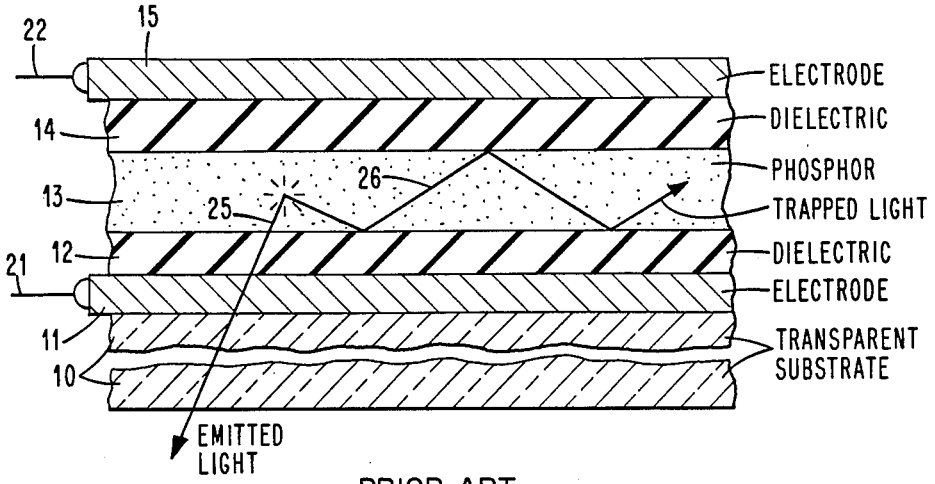
PRIOR ART Fig. 1.
FIG. 1 is a representation in elevational cross-section of a fragment of a thin film electroluminescent device of the prior art.

FIG. 1 illustrates a fragment of a thin film electroluminescent device of conventional prior art construction. The device includes a substrate 10 which is transparent and typically is of glass. A thin transparent conductive electrode 11 which typically is of indium tin oxide or tin oxide is formed on the surface of the glass substrate 10. The conductive electrode 11 is usually of a particular predetermined pattern depending on the display. The electrode 11 is covered by a layer of insulating or dielectric material 12 which may be silicon nitride, silicon oxynitride, barium tantalate, or other suitable material. The thin film electroluminescent phosphor material 13 is deposited on the insulating layer 12. Typically the phosphor film 13 consists of a host material such as zinc sulfide and an activator such as manganese. A second insulating layer 14, which may be of the same material as the first insulating layer 12, or of a different material, is deposited over the phosphor film 13. A second electrode 15, usually of aluminum, is formed on the surface of the insulating layer 14 in a predetermined pattern. As indicated symbolically by the legends 21 and 22, electrical connections are applied to the electrodes 11 and 15, respectively. A voltage applied across the electrodes causes intervening phosphor material to electroluminesce, thus producing a visible display to an observer looking through the glass substrate 10.

The device as described may be fabricated, for example, in accordance with the teachings in U.S. Pat. No. 4,675,092 to Baird and McDonough. In typical prior art devices as described, the substrate and the various layers of the device have flat, planar surfaces and interfaces. The voltage across the phosphor film causes the phosphor to generate light. Some of this light 25 is emitted from the phosphor layer passing through the intervening layers including the glass substrate 10 to be visible to the observer as visible light. A significant portion of the light 26, however, is emitted at angles relative to the planar interfaces 13-14 and 13-12 such that its angle of incidence (the angle between a ray of light and a line perpendicular to the surface at the point the ray strikes the surface) with each interface is greater than the critical angle for the interface between the phosphor material and the insulating material. The phosphor material has a higher refractive index than the insulating material and thus when the critical angle is exceeded, the light is reflected internally of the phosphor layer 13. As indicated in FIG. 1 the internally reflected light 26 is trapped between the interfaces 13-12 and 13-14 of the phosphor layer and the two insulating layers. The phosphor layer 13 acts as a waveguide preventing this light from passing through either of the insulating layers 12 or 14. This light is, in effect, lost.

Figure 2:
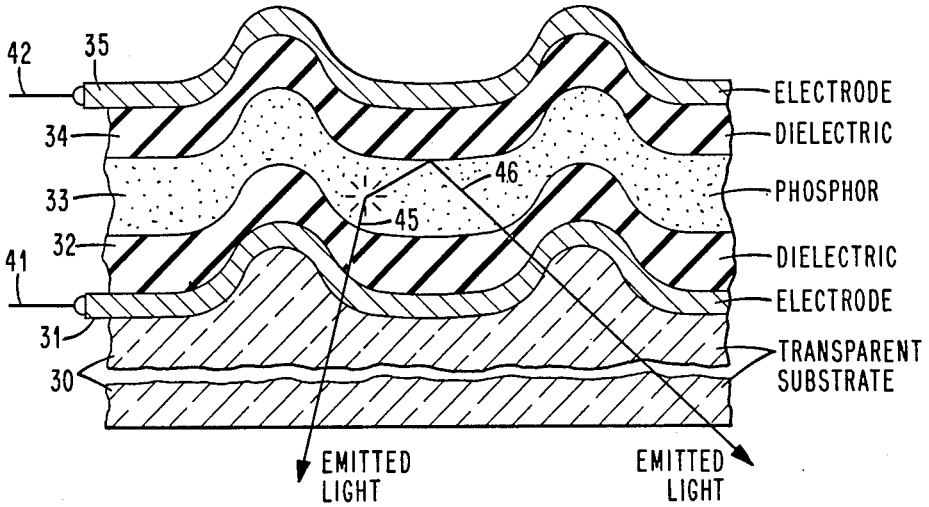
FIG. 2 is a representation in elevational cross-section of a fragment of a thin film electroluminescent device in accordance with the present invention.

In accordance with the present invention the light trapping effect as described hereinabove is reduced by employing a substrate and consequently other layers of the thin film structure which have rough, non-planar surfaces. The transparent substrate 30 has a flat, planar exterior surface, the lower surface as illustrated in FIG. 2. The upper or interior surface is rough and non-planar. That is, the interior surface is not level and has a pattern of disruptions or undulations projecting upward. Desirably, the surface may be a plurality of rounded bumps or rounded depressions. The uneven, disordered interior surface may be formed on the substrate in any of various ways as by chemical etching, mechanical abrading, forming with an appropriate mold, or by some combination of these techniques.

The other layers of the thin film electroluminescent device are formed in sequence on the rough, non-planar surface of the substrate as in prior art devices, for example, employing the teachings of the aforementioned patent to Baird and McDonough. A first transparent conductive electrode 31 of tin oxide or indium tin oxide is deposited on the uneven surface of the substrate 30. Then a layer 32 of insulating or dielectric material is deposited, followed by the phosphor layer 33. The phosphor layer 33 is covered with another layer 34 of insulating material and a second electrode 35 of conductive material, specifically of aluminum, in the desired pattern is formed on the insulating layer 34. Connections labelled 41 and 42 in FIG. 2 are made to the first and second conductive electrodes 31 and 35, respectively.

By virtue of the rough, non-planar surface of the substrate 30, all of the other layers have rough, non-planar surfaces at their interfaces with the contiguous layers. In addition, each of the deposited layers tends to be of slightly uneven or non-uniform thickness because of the deviation of much of the surface from a flat horizontal plane.

As illustrated in FIG. 2, light 45 generated in the phosphor 33 which reaches the interface between the phosphor layer 33 and the insulating or dielectric layer 32 at an angle which is less than the critical angle passes through the insulating material 32 and also through the transparent electrode 31 and the substrate 30. Light 46 which strikes the interface of the phosphor 33 and either insulating layer 32 or 34 at an angle which is greater than the critical angle is reflected back into the phosphor layer. The light is reflected at every point at which it strikes the interfaces 33-32 and 33-34 at an angle greater than the critical angle. The configuration of the layers and their interfaces, however, are such that eventually the light 46 will strike an interface at an angle which is less than the critical angle and thus pass through the insulating layer 32 and the electrode 31 to be visible to an observer.

In a device in accordance with the present invention as with conventionally known devices, the thickness of the first electrode 31 is approximately 100 to 200 nanometers. The dielectric layer of insulating silicon oxynitride 32 is 200 to 400 nanometers thick. The zinc sulfide manganese activated phosphor layer 32 is between 400 and 600 nanometers thick. The second insulating coating of silicon oxynitride 34 is 200 to 400 nanometers thick, and the final evaporated aluminum electrode 35 is between 100 and 200 nanometers thick. The peak light output of the manganese activated zinc sulfide phosphor material is at a wavelength of 570 nanometers. The wavelength of the useful light output is between 540 and 610 nanometers.

As is noted hereinabove, in the prior art devices of FIG. 1, the phosphor layer 13 acts as a waveguide between the two insulating layers 12 and 14 serving to keep trapped light striking the interfaces at an angle greater than the critical angle. In order to ensure that waveuide action cannot take place in the device of FIG. 2, the radius of curvature of the rounded bumps, or of the depressions, in the rough, non-planar surface of the substrate should be no greater than about five times the thickness of the phosphor layer. That is, with a phosphor layer of the order of 500 nanometers thick, the bumps, or depressions should have a radius of curvature which is no greater than 2.5 micrometers.

In prior art devices with an insulating layer 12 of from 200 to 400 nanometers thick, the thickness of the layer may be a half wavelength of some of the light in the spectrum of 540 to 610 nanometers generated in the phosphor. Destructive interference of light with different path lengths through the phosphor and dielectric layers occurs at this wavelength causing discolorations in the observed light. In the device of FIG. 2, however, since the layers are each deposited in order on an underlying rough, non-planar surface, there are some variations in thickness throughout each of the layers. That is, each layer tends to be non-uniform, with greater amounts of deposited material in the valleys and lesser amounts along the sides of the uneven surface. Thus, the areas in which destructive interference occurs are sufficiently small as to be effectively imperceptible and insignificant.

While there has been shown and described what is considered a preferred embodiment of the present invention, it will be obvious to those skilled in the art that various changes and modifications may be made therein without departing from the invention as defined by the appended claims.

What is claimed is:

1. A thin film electroluminescent device comprising a substrate of transparent material having a substantially flat, planar, exterior surface and having a rough, non-planar interior surface;

a first transparent film of conductive material overlying said substrate and adherent thereto; said first transparent film of conductive material having a first rough, non-planar surface contiguous with said rough, non-planar interior surface of said substrate and having a second rough, non-planar surface spaced from said first surface thereof;

a first coating of insulating material overlying said first transparent film of conductive material and adherent thereto; said first coating of insulating material having a first rough, non-planar surface contiguous with said second rough, non-planar surface of said first transparent film of conductive material and having a second rough, non-planar surface spaced from said first surface thereof;

a layer of phosphor material overlying said first coating of insulating material and adherent thereto; said layer of phosphor material having a first rough, non-planar surface contiguous with said second rough, non-planar surface of the first coating of insulating material and having a second rough, non-planar surface spaced from said first surface thereof;

a second layer of insulating material overlying said layer of phosphor material and adherent thereto; said second layer of insulating material having a rough, non-planar surface contiguous with said second rough, non-planar surface of the layer of phosphor material; and a second layer of conductive material overlying said second coating of insulating material and adherent thereto.

2. A thin film electroluminescent device in accordance with claim 1 wherein the first rough, non-planar surface of the phosphor layer forms an interface with the first coating of insulating material which causes light emitted within the layer of phosphor material to strike the interface at less than the critical angle whereby the light passes through the interface.

3. A thin film electroluminescent device in accordance with claim 2 wherein said first coating of insulating material between said first transparent film and said layer of phosphor material is of non-uniform thickness.

4. A thin film electroluminescent device in accordance with claim 3 wherein the rough, non-planar interior surface of the substrate of transparent material comprises a plurality of rounded bumps or rounded depressions.

5. A thin film electroluminescent device in accordance with claim 4 wherein the radius of said rounded bumps or rounded depressions is less than about five times the average thickness of the layer of phosphor material.

* * * * *